US005241721A

United States Patent [19]

Muller

[11] Patent Number: 5,241,721

[45] Date of Patent: Sep. 7, 1993

[54] METHOD OF CONSTRUCTING A CABLE-STAYED BRIDGE COMPOSED OF AN ASSEMBLY OF VOUSSOIRS

[75] Inventor: Jean Muller, Suresnes, France

[73] Assignee: Societe Centrale D'Etudes et de Scetauroute Realisations Routiers, Paris, France

[21] Appl. No.: 765,683

[22] Filed: Sep. 26, 1991

[30] Foreign Application Priority Data

Oct. 11, 1990 [FR] France ..... 9012544

[51] Int. Cl.[5] ..... E01D 11/00

[52] U.S. Cl. ..... 14/22

[58] Field of Search ..... 14/77.1, 17, 18, 20–22

[56] References Cited

U.S. PATENT DOCUMENTS 3,975,476 8/1976 Finsterwalder ..... 14/23 X
3,989,218 11/1976 Muller ..... 14/77.1
4,513,465 4/1985 Schambeck ..... 14/18 X
4,777,686 10/1988 Muller .
4,799,279 1/1989 Muller .

*Primary Examiner*—Ramon S. Britts
*Assistant Examiner*—Nancy P. Connolly
*Attorney, Agent, or Firm*—Watson, Cole, Grindle & Watson

[57] ABSTRACT

Method of constructing a cable-stayed bridge whose deck (1) is composed of two parallel series of voussoirs connected together by connecting members known as deltas (7) which carry at their top part (8) the anchorage points for the cable stays (12). When they are placed in position the bottom parts (9) of the successive deltas are fastened to rigid filling members (14), and auxiliary prestressing cables (13) are preferably installed which connect the top part (8) of a delta to the bottom part (9) of the following delta (7), said cables being approximately in line with the cable stays.

10 Claims, 6 Drawing Sheets prior art 12
19
13A
15
28
16
8
18
22
21
13
23
17
11
20
4
28
20
8
17
IV
IV
29
29
25
10
24
26
11
15
10
26
30
25
24
4

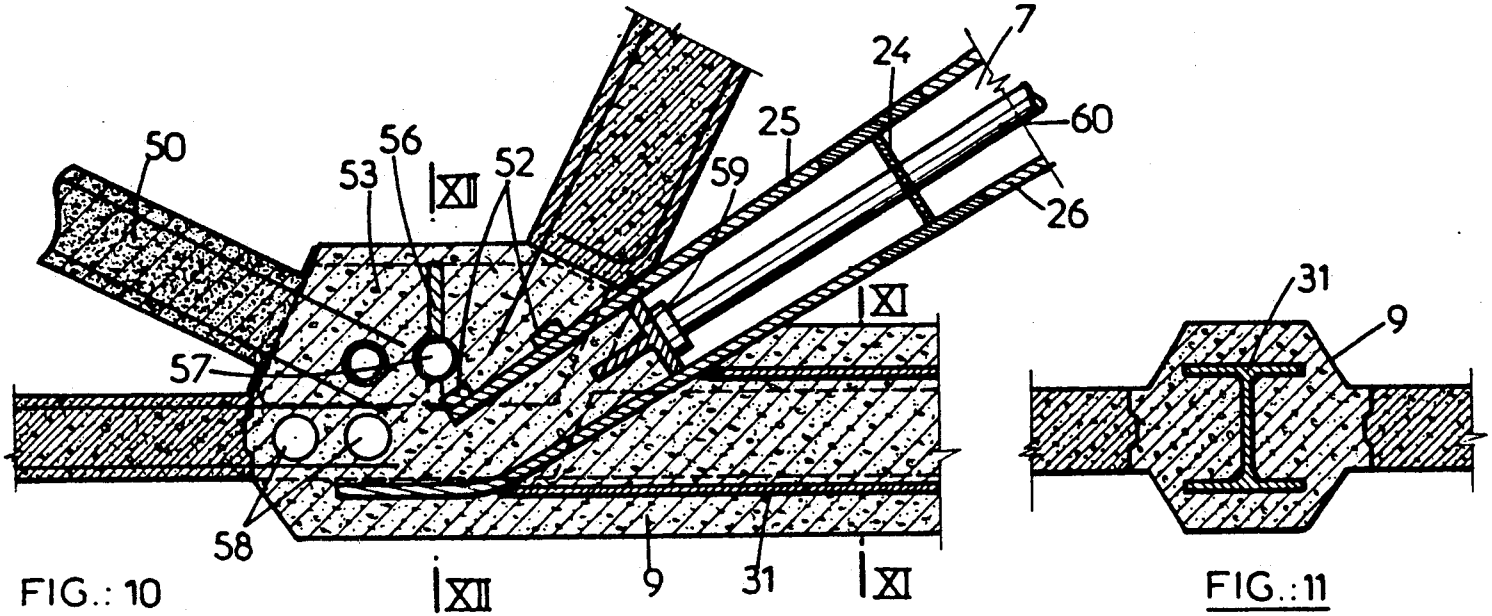
FIG.: 10
FIG.: 11
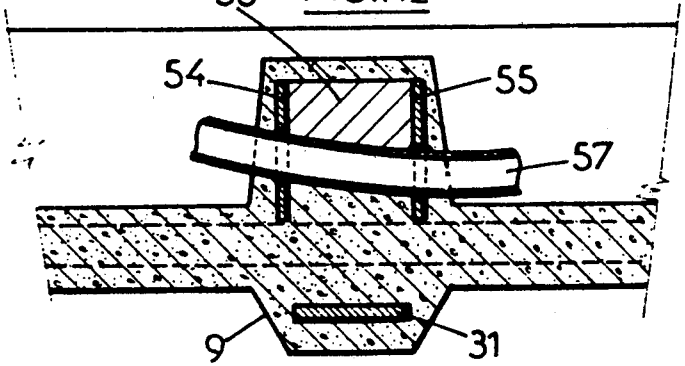
FIG.: 12

METHOD OF CONSTRUCTING A CABLE-STAYED BRIDGE COMPOSED OF AN ASSEMBLY OF VOUSSOIRS

PRIOR ART

The present invention relates to a method of constructing a cable-stayed bridge whose deck is composed of an assembly of separate box girders or voussoirs, and more precisely a bridge whose deck is composed of two parallel series of voussoirs connected by connecting members which carry stay fastening means disposed in a longitudinal plane of symmetry of the structure.

The voussoirs usually have in cross-section the shape of a trapezium whose large base is at the top while its small base is at the bottom. They comprise in fact a horizontal top slab which forms the roadway slab, a bottom slab which is likewise horizontal, and connecting webs, which are usually oblique relative to a vertical plane and connect the two slabs This has the consequence that in cross-section the connecting members have an approximately triangular shape, with a horizontal base which connects the bottom slabs of two voussoirs disposed one on each side of said connecting member, and a narrow top part which connects the edges of the top slabs of two voussoirs and in addition carries fastening means for the stays. Because of their shape, these connecting members are called by those in the trade "delta frames" or more simply "deltas".

A bridge of this kind is built by laying successive voussoirs of each series side by side with the aid of temporary assembly beams and, after they have been placed in position, fastening the successive voussoirs by means of longitudinal prestressing cables. In the construction of the access bays, which rest on multiple piers, this construction poses no great problem, because the assembly beams can rest on two successive piers. On the other hand, for the construction of the central bay, which has a longer span, it is necessary to construct the deck by passing through successive cantilever situations. Starting from one pylon, a first length of deck is prepared, together with the intermediate delta or deltas. A first delta is then supported by connecting it to a stay, the latter being attached to the previously constructed part of the deck on the other side of the pylon, whereupon a second length of deck is placed in position and supported in the same way by a second stay attached to a second delta, and so on until, when the two halves of the central bay have been assembled, they then have only to be keyed together.

A method of this kind is described in particular in U.S. Pat. No. 4,799,279 of the 24th January 1989 in the name of the inventor cited in the present text.

A first completion of a structure of this kind has confirmed the validity of the designs proposed Nevertheless, detailed studies and construction works have revealed certain difficulties, which it is desirable to eliminate in future constructions.

During the use of the structure the following points are in particular noted:

the overall section of the deck is highly dissymmetrical: the total width of the bottom table is equal only to about one-third of the top table, so that the centre of gravity is very close to the latter; compared with a symmetrical section, the stresses set up by the temperature gradients are greatly increased, which is also true of the tensile stresses produced by the passage of overloads in the central zone of the main bay;

torsional strength and stiffness in torsion of the complete deck are achieved only through those properties of the two elementary caissons, because the bottom filling member is interrupted in the transverse direction between the two caissons; these properties are therefore much poorer than those of a deck comprising a single caisson;

in certain cases of dissymmetrical loading, reversal of forces occurs in the parts of the delta frame, which complicates not only the dimensioning of the parts but also, and above all, the making of the connections.

From the constructional point of view, the formation of the central bay is a relatively delicate operation, because during the construction the deck does not possess its final strength. In particular, the phases of placing the voussoirs, delta frames and cable stays in position exert considerable compressive forces on the top connecting filling member, which forces are in addition taken by concrete which has just been poured and therefore has relatively little strength.

In addition, the prestressed reinforced concrete construction of the delta frames, particularly the top connection point receiving the anchorage of the cable stays, entails exceptional density of reinforcements, which makes the construction difficult and expensive

SUMMARY OF THE INVENTION

The present invention seeks to attenuate the difficulties indicated above by providing solutions the application of which permits improvement of the technical value of the structure, a simplification of its construction and a reduction of its cost price.

In order to achieve this result, the invention provides a method of constructing a bridge comprising a deck and at least one pylon connected to the deck by means of cable stays, said deck comprising two series of voussoirs, each disposed on one side of a longitudinal centre plane, each of said voussoirs comprising a horizontal top slab which forms the roadway slab, and a horizontal bottom slab of smaller transverse width, and connecting means or "webs" disposed, between the slabs, in a vertical or oblique longitudinal plane, said voussoirs being connected together in the transverse direction by connecting members known as "deltas", each of which comprises a transverse bottom horizontal beam, which, working in compression, connects together the bottom slabs of two adjacent voussoirs, a transverse top horizontal beam which connects together the top slabs of two adjacent voussoirs, means for fastening a cable stay to the top beam, and oblique beams connecting together the ends of the bottom and top beams, this method comprising the stages of:

a) constructing approach bays by a method comprising the operations consisting of:
   - $a_1$) disposing at least one longitudinal assembly beam between two successive piers,
   - $a_2$) successively placing voussoirs in position between the two piers, causing them to circulate on the assembly beam, until the entire space between piers is filled,
   - $a_3$) fastening the adjacent voussoirs together, one of the end voussoirs being connected to an abutment,
   - $a_4$) repeating operations $a_1$) to $a_3$), each time fastening an end voussoir, which has been placed in position in a stage $a_2$), to an end voussoir placed in position in a preceding stage $a_2$), until a pylon is reached;

$b_1$) constructing a main bay, starting from the pylon, by a method comprising the operations consisting in:

$b_1$) placing voussoirs successively in position in a cantilever arrangement, connecting them each time to a previously fixed voussoir, until the intended site for the anchoring of a cable stay is reached, $b_2$) at the intended site for the anchoring of a cable stay placing a delta in position between two adjacent voussoirs and connecting it to the latter, $b_3$) placing in position a cable stay anchored in the delta, $b_4$) repeating operations $b_1$) to $b_3$) as far as the end of the part of the bay supported by the pylon, $b_5$) where necessary, carryinq outoperations $b_1$) to $b_4$) from the opposite pylon of the central bay, advancing in the opposite direction, and keying together the two halfbays thus produced, this method being characterized in that during the operation $b_2$) a horizontal filling member is also installed to connect the bottom beam of the delta to the bottom beam of the delta previously placed in position.

By "filling member" is meant a horizontal member, preferably of concrete, which has good longitudinal compressive strength The filling member is preferably connected at its edges to the bottom slab of the adjacent voussoirs, thereby effectively increasing the torsional strength of the deck on its longitudinal axis.

At the site of the pylon a support member, which may or may not be fastened to the pylon, may replace a delta and serve the same purposes, except the anchoring of a cable stay.

Consequently, according to the invention the longitudinal forces are shared between the top part of each delta and its bottom cross member. The presence of the filling members according to the invention in the bottom part has the effect of considerably reducing the dissymmetry of the overall section of the deck and of lowering its centre of gravity. In addition, the fact that a rigid structure now exists, which is formed by the deltas and the filling members joining their bottom part between the voussoirs, increases the torsional strength and stiffness in torsion of the deck.

The bottom beam of the delta which has just been put in position is preferably connected, by means of at least one oblique auxiliary prestressing cable, to the top beam of the delta previously placed in position In the longitudinal vertical plane a triangulation is thus formed between a delta, the part of the deck already constructed and the prestressing cable connecting the cross member of said delta to the top part of the preceding delta, thereby achieving a further increase of rigidity and in addition reducing almost by half the compressive stresses exerted on the top slab during the construction, as will be explained further on.

According to one interesting procedure, at the end of the construction of the main bay at least some of the auxiliary prestressing cables are removed and replaced by definitive prestressing cables anchored at their ends on the top beams of two non-adjacent deltas and diverted in the vicinity of the bottom beams of the deltas situated between said deltas carrying the anchorages of the prestressing cables.

By operating in this way the prestressing cables which have become unnecessary are recovered, but advantage is taken of their anchorage points on the top beams of the deltas.

In the case of a bridge in which the symmetrical bay extends between two pylons and has a transverse plane of symmetry, it is preferred that said definitive prestressing cables should connect together the top beams of two deltas disposed symmetrically in relation to said transverse plane of symmetry.

In order to gain weight or rigidity it is advantageous to use deltas of essentially metallic construction. In this case, in order to take into account the different modules of elasticity of the concrete of the voussoirs and the metal of the deltas it is preferable to subject the oblique beams of the deltas to provisional predeformation by applying to them a tensile stress, and this tensile stress is discontinued when the bridge has been completed.

According to an operating procedure which is customary, between the voussoirs of the part of the approach bay which will subsequently be cable-stayed, a provisional longitudinal prestress is established, the prestressing cables starting from the apex of end voussoirs and extending to the bottom part of intermediate voussoirs with the aid of diverter saddles. In this case, according to an advantageous embodiment of the invention, the diverter saddles of at least some prestressing cables are placed in the cutout of the voussoir which also receives the bottom part of a delta serving to anchor one of the cable stays, and are outside said delta, so that these cables can be removed on completion of the construction.

The invention also provides a bridge which is constructed in accordance with the method described above and in which the point of intersection of the axes of the bottom beam and of an oblique beam of a delta is situated on the line of intersection of the centre planes of the bottom slab and of an adjacent connection means between the bottom and top slabs of a voussoir In addition, thrust beams are preferably provided which are disposed obliquely in the transverse plane of the deltas and connect the point of intersection of the axes of the bottom beam and of the oblique beam of the delta at a selected point on the top slab of the corresponding voussoir.

The two oblique beams of the delta are advantageously formed by one and the same girder bent in its central part, the zone of the bent part serving for the connection of said girder to the top beam of the delta and being reinforced by transverse plates to receive the anchorages of the cable stay and of the auxiliary prestressing cable or cables.

BRIEF DESCRIPTION OF THE DRAWINGS

The invention will now be explained in greater detail with the aid of practical examples illustrated in the drawings, in which:

FIG. 10 is a vertical cross-section of a delta and its connection to the bottom slab of a voussoir, reference X in FIG. 2, FIGS. 11 and 12 are longitudinal vertical sections corresponding to the lines XI—XI and XII—XII in FIG. 10.

DETAILED DESCRIPTION OF A PREFERRED EMBODIMENT OF THE INVENTION

Figure 1:
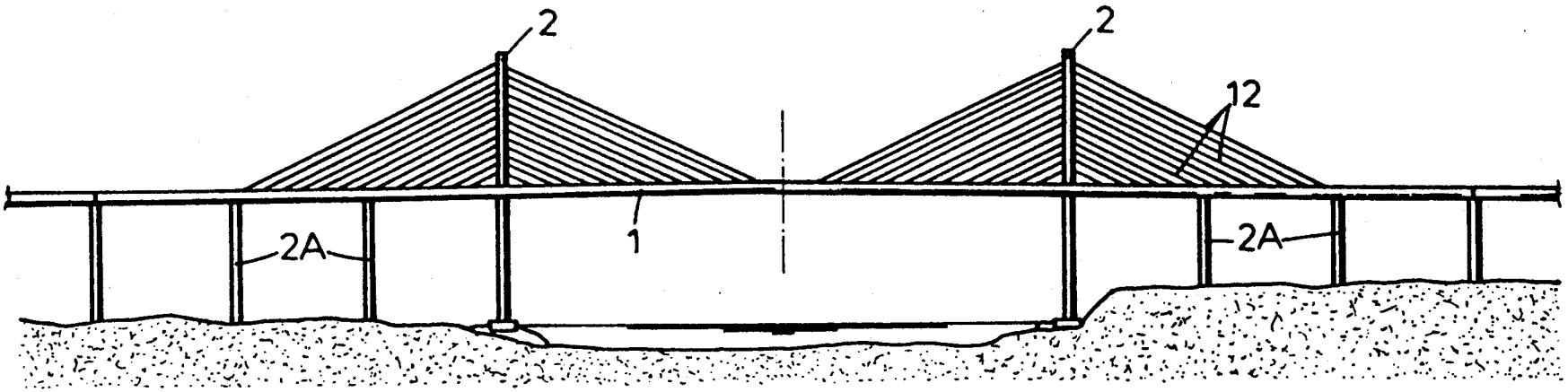
FIG. 1 is a general view in elevation of a cable-stayed bridge.

FIG. 1 shows a cable-stayed bridge composed of a deck 1, two pylons 2 disposed one on each side of a central bay, and piers 2A supporting the access bays.

Figure 2:
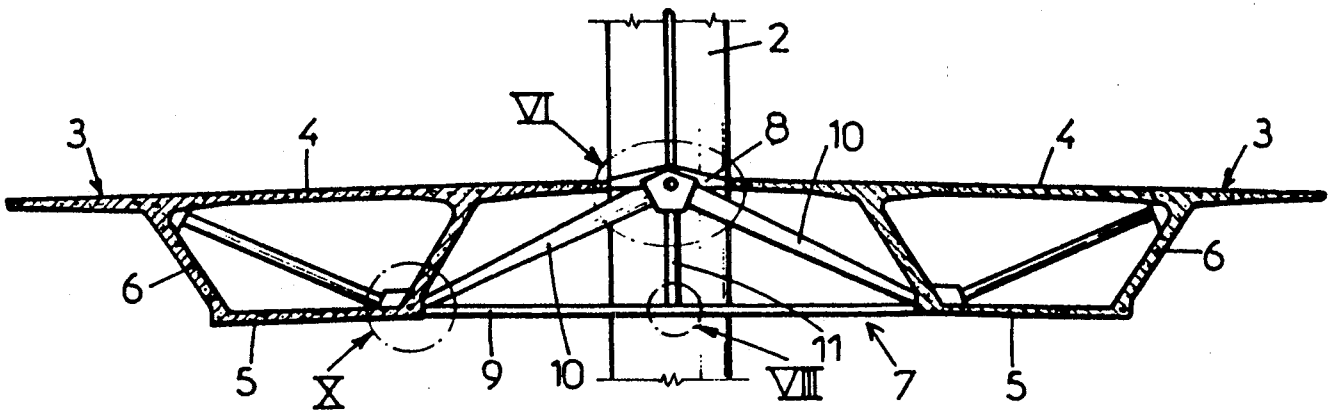
FIG. 2 is a cross-section of the deck of the bridge shown in FIG. 1.

As shown in FIG. 2, the deck consists of two parallel series of voussoirs 3 disposed one on each side of the vertical centre plane of the structure. Each voussoir 3 comprises a top slab 4, which serves as roadway, and a bottom slab 5 the width of which is about one third that of the top slab, together with connecting webs 6 disposed in oblique planes relative to the longitudinal vertical plane and defining, with the slabs 4 and 5, an internal space of trapezoidal section. The connecting members or "deltas" 7 are disposed between the two voussoirs of one and the same cross-section They comprise a top transverse beam 8 of slight length, which connects the neighbouring edges of the top slabs 4 of two voussoirs, a bottom beam 9 which is much longer and which connects the bottom slabs 5 of two neighbouring voussoirs, and two oblique connecting beams 10 which connect the top beam 8 to each end of the bottom beam 9. In addition, a vertical beam 11 connects, in the central median plane, the top beam 8 to the bottom beam 9. The length of the top beam 8 is equal to the width of a pylon 2 thus making it possible to have rectilinear roadways The cable stays 12 are attached at the bottom to the centre of the top beam 8 of a delta, and these cable stays are diverted over the pylons 2 and anchored at corresponding points in each access bay.

Figure 3:
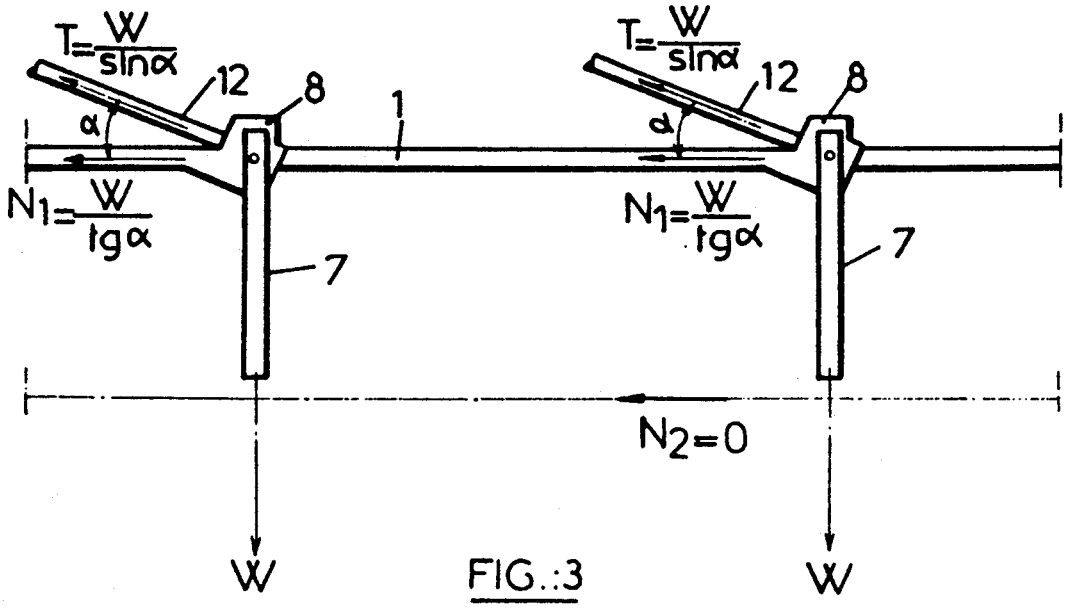
FIG. 3 is a longitudinal vertical section of a part of a deck according to the prior art.

FIG. 3 shows that the forces which in accordance with the prior art are exerted on the top beam of a delta 7, and which comprise the weight W of the delta and of the part of the deck 1 which is attached to it, and the tension force T resulting from the tension of the cable stay 12. If $\alpha$ designates the angle formed by the cable stay with the deck, equilibrium is written by the equation $$T = \frac{W}{\sin \alpha}$$

and this results in a horizontal compression force of the deck $N_1 = W/\tan \alpha$.

Figure 4:
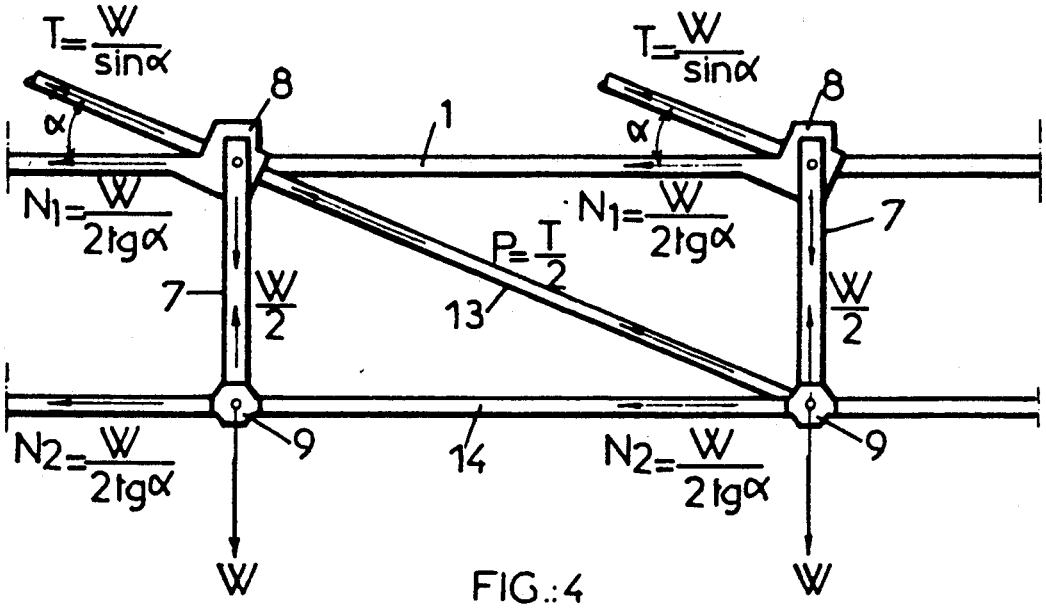
FIG. 4 is a section similar to FIG. 3, but corresponding to a bridge constructed in accordance with the invention.

Referring now to FIG. 4, the interest of the invention can be understood The top beam 8 of a delta 7 is connected to the bottom beam of another delta 7, at a greater distance from the pylon, by an auxiliary prestressing cable 13. In addition, the bottom beams 9 of two successive deltas are connected together by a horizontal filling member 14 of concrete, that is to say a compression resistant member.

If it is assumed that the prestressing cables 13 transmit half the tension of the cable stay and are directed substantially in the same direction, it will be seen that the horizontal compression stress produced at the top beam is divided by two: $N_1 = W/2 \tan \alpha$ and that an equal stress $N_2$ is exerted by the bottom beam 9 on the adjacent filling member.

For the auxiliary prestressing cables 13 to form with the deck the same angle $\alpha$ as the cable stays it is necessary that the ratio of the height of a delta to the distance between two successive deltas should be equal to $\tan \alpha$, for which provision can be made in the design. The angle $\alpha$ between the cable stay and the deck may vary slightly with the distance from the pylon, even with harp type staying in which the cable stays are substantially parallel, because the deck has a certain curvature. The differences are however slight, and the statement made above remains substantially valid.

Figures 5, 6:
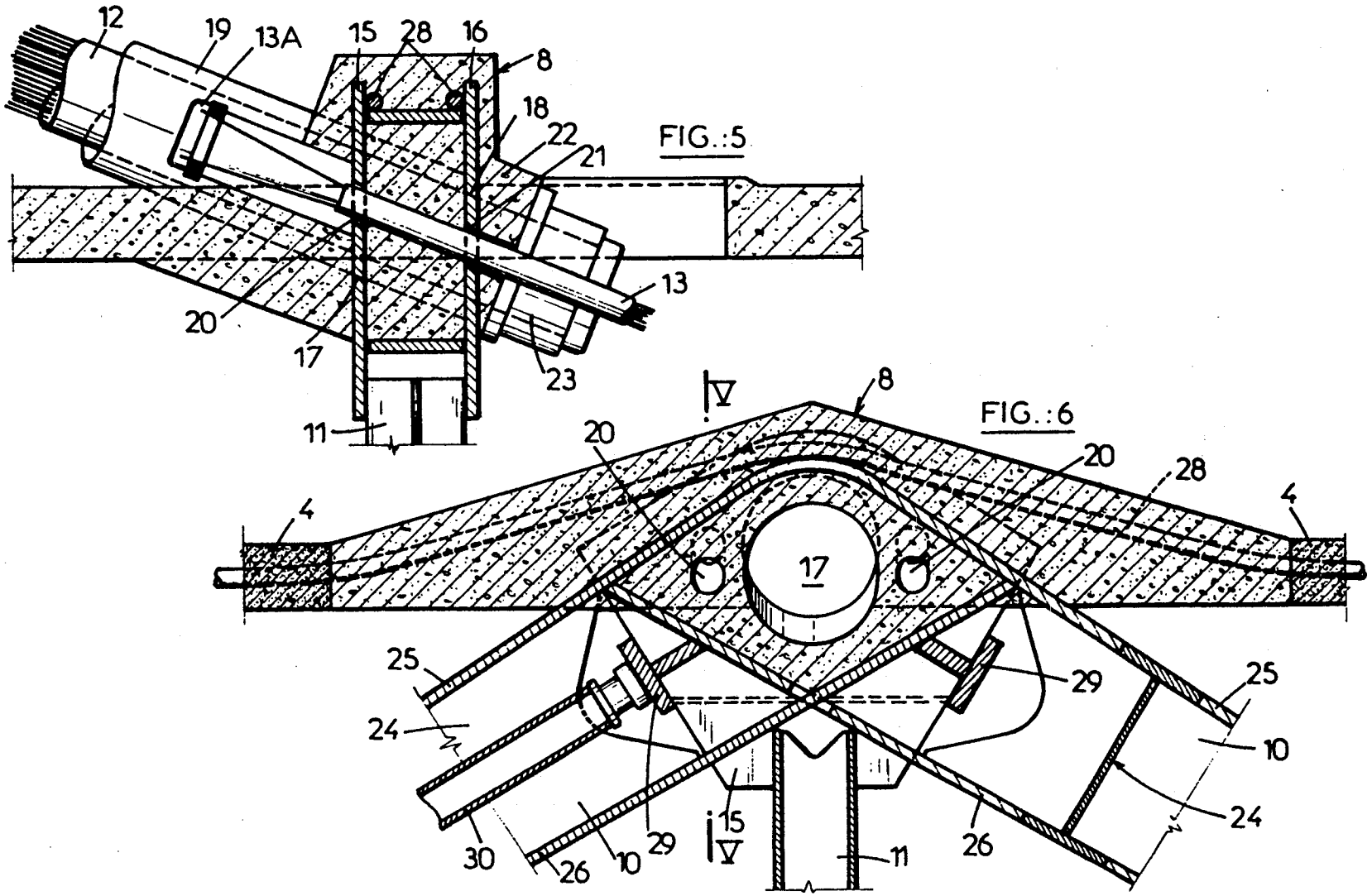
FIGS. 5 and 6 are respectively a longitudinal section, taken on the line V—V in FIG. 6, and a cross-section, on a larger scale, of a delta, in the region of its top beam, reference VI in FIG. 2, FIGS. 7 and 8 are respectively a longitudinal section and a cross-section of the bottom beam of a delta, in its central part given the reference VII in FIG. 2.

FIGS. 5 and 6 make it possible to explain the structure of the top beam 8 of a delta, of its connections to the oblique beams 10, and of the means fastening the cable stay 2 on the one hand and the supplementary prestressing cables 13 on the other hand.

The top beam 8 has the general shape of a flattened triangle whose ends are connected to the edges of the top slabs 4 of the two adjacent voussoirs On each of its transverse faces the beam 8 carries in its central part a metal support plate 15, 16 which has the general shape of a pentagon In its vertical plane of symmetry each of these plates has a main passage 17, 18 intended to receive the cable stay 12. The two apertures 17, 18 are not disposed at the same height, the difference corresponding to the inclination of the cable stay 12. In addition, the passage 17 situated in the higher position is larger than the passage 18, so as also to permit the passage of the cable stay sheath 19. On each side of the passages 17 and 18 are provided passages 20, 21 whose axis is at the same level as the axis of the passages 17, 18. These passages 20, 21 are intended for the auxiliary prestressing cables. The plates 15 and 16 are embedded in a concrete mass 22 of suitable shape to serve as support point for the anchorage head 23 of the cable stay 12 on the one side and for the anchorage head 13A of each of the auxiliary prestressing cables 13 on the other side.

The oblique beams 10 are formed from a single piece in the form of an I-section girder whose web 24 lies in a transverse vertical plane. Properly speaking this member does not constitute a sectional member, because its section is not constant. Its web 24 widens in fact from bottom to top. Said web 24 is interrupted in the vicinity of the plates 15, 16, but the top flange 25 is extended between the plates 15 and 16, being curved downwards. The bottom flanges 26 of the two sides cross one another on the vertical axis of symmetry, each of them having a cutout extending over half the width of the flanges 26 and continuing until they come to bear against the folded flange 25 beyond the curvature point, while the other flange 26 comes to bear against the same flange 25 on the other side of the bend point. Between the plates 15 and 16, the bent top flange 25 and the two half-flanges 26, an almost closed internal space having great rigidity is thus delimited, which serves as a resistant mass intended to withstand the forces exerted by the cable stay and subsidiarily by the supplementary prestressing cables 13. This space is filled with concrete after the sheaths for the cable stay and the prestressing cables have been placed in position in it. The vertical beam 11 disposed substantially in the axial plane is also held between the plates 15 and 16.

Cables 28 for transverse stressing connect together the top slabs 4 of the two adjacent voussoirs, passing through the beam 8 of the delta and bearing against the top face of the bent flange 25 of the girder which forms the oblique beams 10, between the plates 15 and 16.

Support plates 29 at right angles to the direction of the oblique beams 10 are supported by the edges of the plates 15 and 16. They are intended to serve as stops for jacks 30, described further on, tensioning the oblique beams 10. Only one of these jacks is partly shown in FIG. 6.

Figure 8:
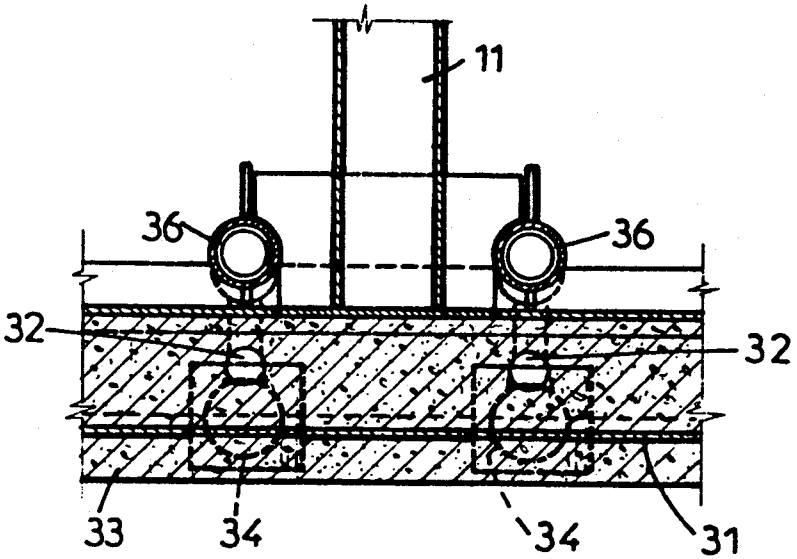
Figure 7:
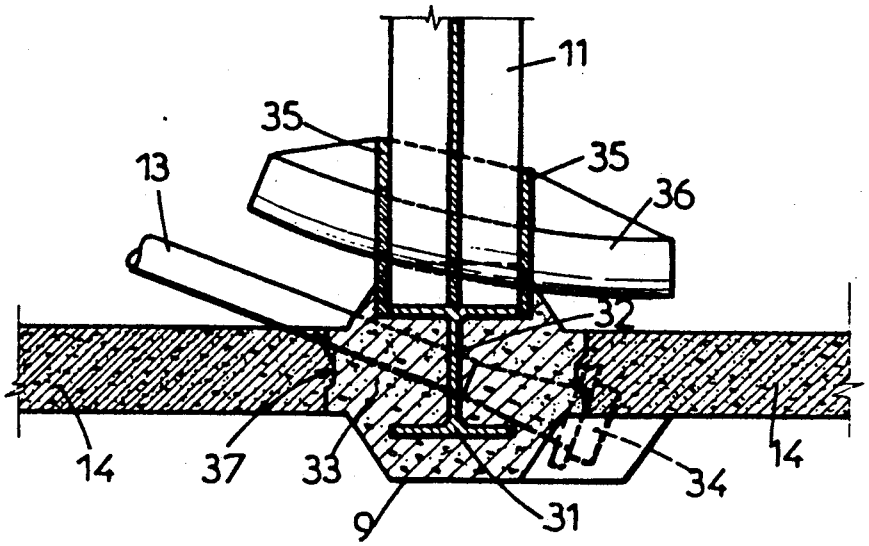

FIGS. 7 and 8 show the structure of the delta in the vicinity of the centre of its bottom beam 9. This beam consists essentially of a metal I-section 31 which extends between the edges of the bottom slabs 5 of adjacent voussoirs 3. In its central part the vertical flange of the section 31 has two passages 32 pierced in it, the distance between them being approximately equal to that of the passages 20, 21 provided in the plates 15 and 16, and these two passages being situated at the same level. They are intended to receive the auxiliary prestressing cables 13. The entire section 31 is embedded in a concrete mass 33, the shape of which is designed to serve as support point for the bottom anchorage head 34 of the cables 13. The vertical beam 11 is welded by its bottom end to the section 31, halfway between the passages 32, and thus serves as reaction means intended to transmit the vertical forces between the central part of the bottom beam 9 and the top beam 8. Two longitudinal vertical plates 35 are welded one on each side of the top flange of the section 31 and of the vertical beam 11. These vertical plates hold tubular parts 36 disposed in a longitudinal vertical plane and forming an arc of a circle, one of the ends of the tubes 36 being directed towards the passages 21 of the top part of the neighbouring delta, while their other end is horizontal. It will be understood that these tubular parts serve to divert the prestressing cables which on completion of the assembly of the bridge will be installed to replace the auxiliary prestressing cables 13. These new prestressing cables will be anchored in the top beam at the same point as the cables 13 and will serve to join the deck parts together in the longitudinal direction.

It will be noted that the bottom beam 9 has vertical transverse faces 37 provided with tenons and/or recesses. This particular shape is intended to cooperate with a corresponding shape of the filling member 14, in order to enable the latter to be held in position.

FIGS. 9 to 12 make it possible to explain the structure of the connection between a bottom beam 9 of a delta and the bottom slab 5 of a voussoir. This entails a rather complex node of members, in which not only the longitudinal planes of symmetry of the bottom slab 5 and of an oblique web 6 of the voussoir, but also the axes of the bottom beam 9 of an oblique beam 10 of the delta and of a thrust member or diagonal brace 50, provided for transmitting the forces in the direction of the opposite corner of the section of the voussoir (see FIG. 2), must converge at one and the same point.

Figure 9:
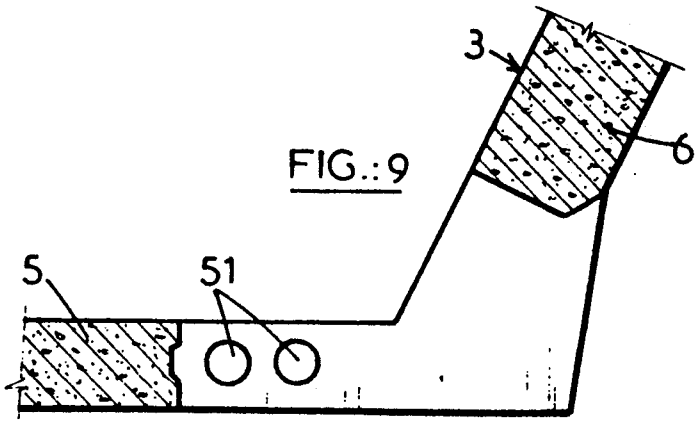
FIG. 9 is a partial cross-section of a voussoir before its connection to the bottom part of a delta is placed in position.

As shown in FIG. 9, the closed section of the voussoir is cut away at the connection point in order to allow the bottom end of the delta to penetrate in the direction of the apex of the polygon formed by the section of this voussoir. Continuity between the bottom slab 5 and the oblique web 6 is no longer achieved over a short length before the connection is made to the delta, in the course of which operation this continuity will be restored. The passages 51 of the prestressing cables intended to connect the voussoirs together in the longitudinal direction are however retained.

The metal I-section constituting the oblique beam 10 of the delta is welded by its bottom flange 26 to the member 31, which is suitably cut obliquely. It is here repeated that the section of this member is not constant and that the width of the web is much greater at the position of the top beam (see FIG. 6) than at the position of the bottom beam. The web 24 of this member is cut at the point where the latter reaches the member 31. Nevertheless, the bottom flange 26 is extended further and is then bent into a horizontal position, thus forming an extension of the bottom flange of the member 31. The top flange 25 is likewise extended beyond the interruption of the web 24, but without being bent. Fastening parts 52 have been welded to it to serve to anchor this member in the neighbouring concrete. The whole assembly is in fact enclosed in a concrete mass 53, the shapes of which are designed for good connection on the one hand to the bottom slab 5 and the oblique webs 6 of the voussoir, and also to provide a support surface for the diagonal brace 50. The figure also shows two transverse vertical plates 54, 55 held by a spacer plate 56 and embedded in the mass 53, these plates being welded to the flange 25. These plates serve to support incurved guide tubes 57 (see FIG. 12), which constitute saddles intended to divert the provisional prestressing cables serving to connect together the successive voussoirs of the approach bays during construction. These cables are removed on completion of the assembly.

Passages 58 are provided in the mass 53 to extend the passages 51 provided in the bottom slab 5 for voussoir prestressing cables. In addition, a support plate 59 at right angle to the oblique member 10 and intended to serve as a stop for compression rods 60, of which only one is shown in FIG. 10, is carried by a suitable surface of the mass 53.

Figure 13:
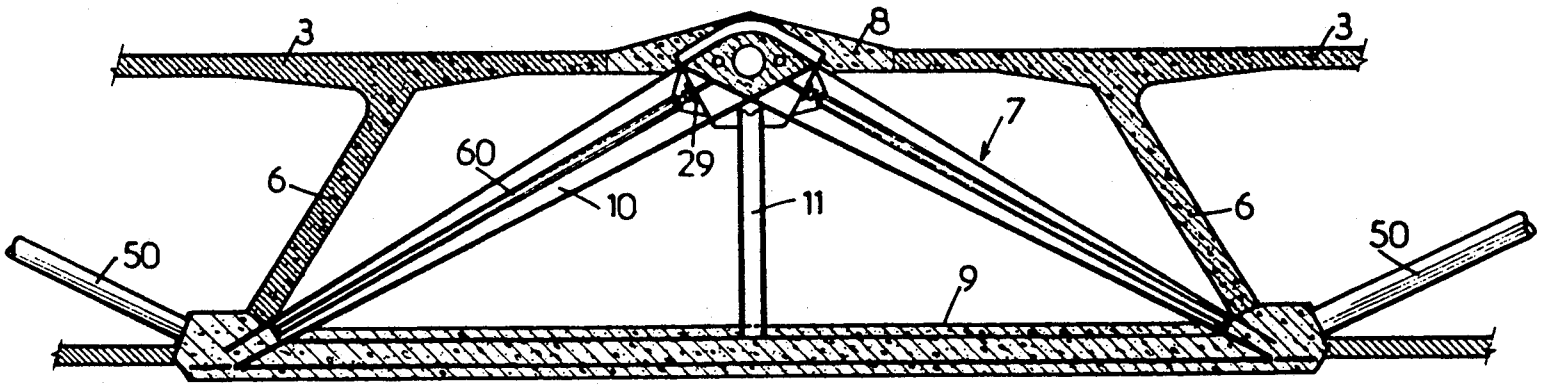
FIG. 13 is a general view of a metal delta, showing the provisional prestressing means.

FIG. 13 is a general view of a delta 7 according to the invention. It can be seen that the top beam 8 and the bottom beam 9 consist of metal beams embedded in concrete, whereas the oblique beams 10 and the vertical beam 11 are "bare" metal members. This gives rise to differences in compressibility, which are all the greater because the voussoirs 3 consist entirely of concrete.

In order to compensate for these differences, on each side of each oblique beam 10 provisional tensioning means are provided along the latter, each of said means comprising a compression rod 60 disposed along the web and bearing at the bottom of the beam 10 against the support part 59 (see FIG. 10), the latter being in turn supported by the concrete mass surrounding the connection of the delta to the bottom part of the voussoir. At the top of the rod 60 a jack 30 (see FIG. 6), for example one equipped with a safety nut, bears on the one hand against the rod 60 and on the other hand against the support member 29 visible in FIG. 6. In principle there are thus an even number of thrust rods and jacks, for example 2 or 4, disposed on the opposite faces of the web 24 of the member 10. In the course of assembly the force of the jacks 30 serves to prevent shortening of the oblique beam 10 and consequently of the vertical beam 11 through the action of vertical compressive forces W/2, which are shown in FIG. 4.

At the end of the assembly of the bridge the rods 60 and the jacks 30 are removed and recovered.

Figure 14A:
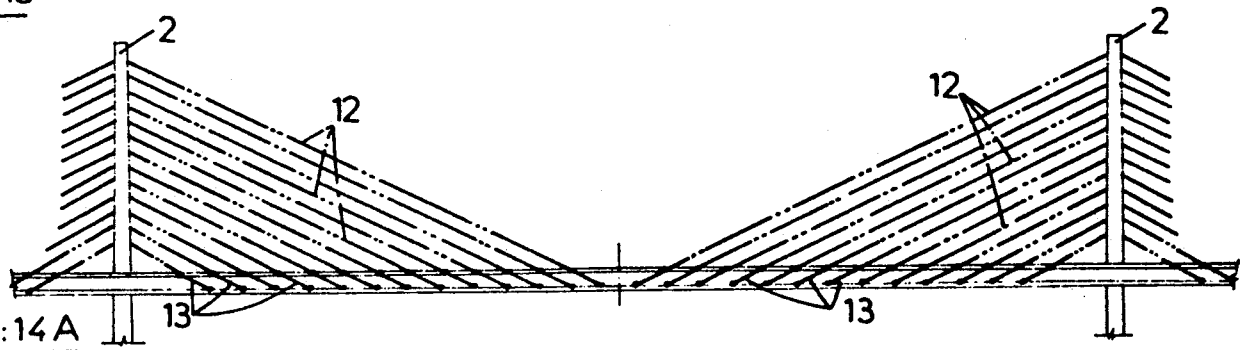
FIGS. 14A and 14B are diagrams of the central bay of a bridge, showing the position of the auxiliary and definitive prestressing cables.
Figure 14B:
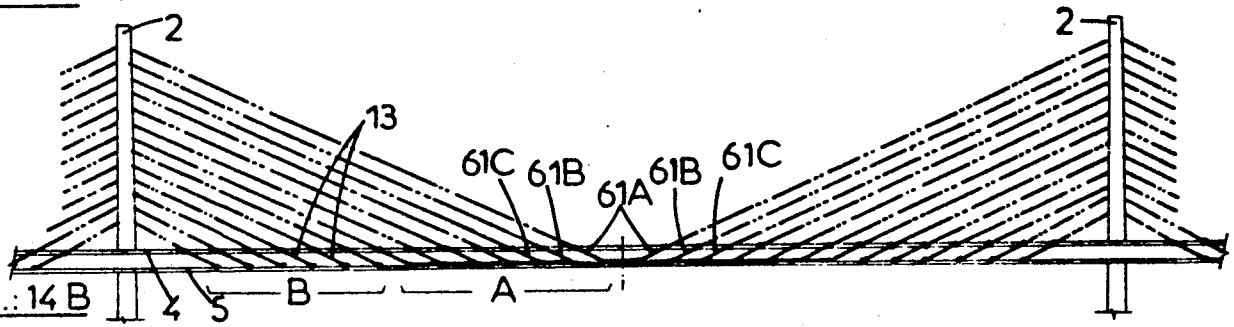

FIGS. 14A and 14B illustrate the replacement of certain auxiliary prestressing cables by definitive prestressing cables.

FIG. 14A shows the situation immediately after the half-bays have been fastened together. Each of them has a number of auxiliary prestressing cables 13 displaced substantially in line with the cable stays 12.

FIG. 14B shows the situation when the central bay has been completed. The auxiliary prestressing cables 13 closest to the middle of the bay have been replaced by definitive prestressing cables which connect the halfbays together. A first definitive cable 61A connects together the cable stay anchorage points closest to the middle. A second definitive cable 61B connects together the two second cable stay anchorage points, counting from the middle. Similarly, a third definitive cable 61C connects together the third anchorage points, and so on. Each definitive cable starts from a cable stay anchorage point situated at the level of the top slab 4 to another anchorage point situated at the same level, and is diverted by two tubular members 45 situated at the level of the bottom slab 5. The cables 61B, 61C, etc. extend through the intermediate deltas, passing from one or the other side of the vertical beam without being diverted, and simply being held in such a manner as to limit vibration.

Replacement of the auxiliary prestressing cables 13 by definitive prestressing cables is effected over only a part of the length of each half-bay. In this part, given the reference "A", the bridge deck is thus subjected to prestressing directed towards the middle of the bay and opposing the horizontal component of the forces exerted by the cable stays, which is directed towards the pylon.

On the part of the deck which is closest to the pylon, and which is designated B, the auxiliary prestressing cables 13 are left in place.

Claim:

1. A method of constructing a bridge comprising a deck and at least one pylon connected to the deck by means of cable stays, said deck comprising two series of box girders, each disposed on one side of a longitudinal centre plane, each of said box griders comprising a horizontal top slab which forms the roadway slab, and a horizontal bottom slab of smaller transverse width, and connecting means disposed, between the slabs, in a vertical or oblique longitudinal plane, said voussoirs being connected together in the transverse direction by connecting members each of which comprises a transverse bottom horizontal beam, which, working in compression, connects together the bottom slabs of two adjacent box griders, a transverse top horizontal beam which connects together the top slabs of the two adjacent box griders, means for fastening a cable stay to the top beam, and oblique beams connecting together the end of the bottom beam to that of the top beam, this method comprising the steps of:

a) constructing approach bays by a method comprising the operations consisting of:

$a_1$) disposing one longitudinal assembly beam between two successive piers, $a_2$) successively placing box griders in position between the two piers, causing them to circulate on the assembly beam, until the entire space between piers is filled, $a_3$) fastening the adjacent box griders together, one of the end box griders being connected to an abutment, $a_4$) repeating operations $a_1$) to $a_3$), each time fastening an end box griders, which has been placed in position in a stage $a_2$), to an end box griders placed in position in a preceding stage $a_2$), until a pylon is reached;

b) constructing a main bay, starting from the pylon, by a method comprising the operations consisting of:

$b_1$) placing box griders successively in position in a cantilever arrangement, connecting them each time to a previously fixed box griders, until the intended site for the anchoring of a cable stay is reached, $b_2$) at the intended site for the anchoring of a cable stay placing a connecting member in position between two adjacent box griders and connecting it to the latter, $b_3$) placing in position a cable stay anchored in the delta, $b_4$) also placing in position a horizontal filling member connecting the bottom beam of the connecting member to the bottom beam of the connecting member previously placed in position, $b_5$) repeating operations $b_1$) to $b_3$) as far as the end of the beam of the bay supported by the pylon, $b_6$) where necessary, carrying out operations $b_1$) to $b_4$) from an opposite pylon of the central bay, advancing in the opposite direction, and keying together the two half-bays thus produced.

2. The method according to claim 1, in which by means of at least one oblique auxiliary prestressing cable the bottom beam of the connecting member which has just been placed in position is connected to the top beam of the connecting member previously placed in position.

3. The method according to claim 2, in which at the end of the construction of the main bay at least some of the auxiliary prestressing cables are removed and replaced by definitive prestressing cables anchored at their ends on the top beams of two non-adjacent connecting members and diverted in the vicinity of the bottom beams of the situated between said deltas carrying the anchorages of the prestressing cables.

4. The method according to claim 3, in which the central bay of the bridge extends between two pylons and has a transverse plane of symmetry, and said definitive prestressing, cables connect together the top beams of two connecting members placed symmetrically in relation to said transverse plane of symmetry.

5. The method according to claim 1, in which use is made of connecting members of essentially metallic construction.

6. The method according to claim 5, in which the oblique beams of the connecting members are subjected to provisional predeformation by applying to them a tensile stress, and this tensile stress is discontinued when the bridge has been completed.

7. The method according to claim 1, in which between the box girders of the part of the approach bay which will subsequently be cable-stayed a provisional longitudinal prestress is established, the prestressing cables starting from the apex of end box girders and extending to the bottom part of intermediate box girders with the aid of diverter saddles, and the diverter saddles of at least some prestressing cables are placed in the cutout of a box girders receiving the bottom part of a connecting member intended for anchoring one of the cable stays, and are outside said connecting member so that said cables can be removed on completion of the construction.

8. The method according to claim 1, in which the point of intersection of the axes of the bottom beam and of an oblique beam of a connecting member is situated on the line of intersection of the centre planes of the bottom slab and of the connecting means between the bottom and top slabs of a box girder.

9. The method according to claim 8, in which diagonal braces are in addition disposed obliquely in the transverse plane of the connecting members to connect the point of intersection of the axes of the bottom beam and of the oblique beam of the connecting member at a selected point on the top slab of the corresponding voussoir.

10. The method according to claim 8, in which the two oblique beams of the connecting member delta are formed by one and the same girder bent in its central part, the zone of the bent part serving for the connection of said girder to the top beam of the connecting member and being reinforced by transverse plates to receive the anchorages of the cable stay and of the auxiliary prestressing cable or cables.

* * * * *